US012508464B2

(12) United States Patent
Wang

(10) Patent No.: US 12,508,464 B2
(45) Date of Patent: Dec. 30, 2025

(54) KETTLEBELL

(71) Applicant: MAGNATE HEALTH TECH. CO., LTD., Taipei (TW)

(72) Inventor: Lopin Wang, Taipei (TW)

(73) Assignee: MAGNATE HEALTH TECH. CO., LTD., Taipei (TW)

( * ) Notice: Subject to any disclaimer, the term of this patent is extended or adjusted under 35 U.S.C. 154(b) by 52 days.

(21) Appl. No.: 18/601,872

(22) Filed: Mar. 11, 2024

(65) Prior Publication Data

US 2025/0281788 A1 Sep. 11, 2025

(51) Int. Cl.
*A63B 21/075* (2006.01)
*A63B 21/00* (2006.01)
*A63B 21/072* (2006.01)

(52) U.S. Cl.
CPC ..... *A63B 21/075* (2013.01); *A63B 21/0728* (2013.01); *A63B 21/4035* (2015.10)

(58) Field of Classification Search
CPC ..... A63B 21/075; A63B 21/0728; A63B 21/4035; A63B 21/072–075; A63B 21/0726; A63B 21/0724; A63B 71/0036; A63B 21/06; A63B 21/00065; A63B 21/0004
See application file for complete search history.

(56) References Cited

U.S. PATENT DOCUMENTS 7,563,208 B1 * 7/2009 Chen ..... A63B 21/075 482/93
10,099,083 B1 * 10/2018 Owusu ..... A63B 24/0062
11,185,731 B2 * 11/2021 Wang ..... A63B 21/072
2010/0190619 A1 * 7/2010 Chen ..... A63B 21/072 482/108
2018/0117387 A1 * 5/2018 Wang ..... A63B 21/072
2018/0169460 A1 * 6/2018 Chen ..... A63B 21/075
2019/0240526 A1 * 8/2019 Owusu ..... A63B 21/00065
2020/0114204 A1 * 4/2020 Owusu ..... A63B 24/0087
2020/0360757 A1 * 11/2020 Flick ..... A63B 71/0054
2021/0023411 A1 * 1/2021 Wang ..... A63B 21/075

FOREIGN PATENT DOCUMENTS

TW I810242 B 8/2023

* cited by examiner

*Primary Examiner* — Megan Anderson
*Assistant Examiner* — Catrina A Letterman
(74) *Attorney, Agent, or Firm* — Guice Patents PLLC

(57) ABSTRACT

A kettlebell comprises a main weight block and several weight blocks, a teeth meshing plate is disposed on a top surface of the main weight block; a rotating shaft having an upper engaging rod and a lower engaging rod, the lower engaging rod optionally engages on the teeth meshing plate; a large teeth plate can move elastically, the large teeth plate is provided with first engaging teeth on a periphery of a through hole annularly; a connecting plate annularly provided with second engaging teeth movably meshing with the first engaging teeth, a lower end surface of the connecting plate is annularly provided with connecting teeth connected with the upper engaging rod. Positions of the connecting plate can be changed through the upper engaging rod, the main weight block can be fixed on the lower engaging rod, so that actions of the kettlebell can be switched reliably, and the rotating shaft can rotate freely without weight.

12 Claims, 9 Drawing Sheets

KETTLEBELL

FIELD OF THE INVENTION

The invention relates to a kettlebell, and more particularly to a kettlebell that can be conveniently adjusted.

DESCRIPTION OF THE RELATED ART

Conventional kettlebells can be used to perform various types of exercise training. A variety of exercises can be performed through kettlebells of different weights. Users often need many kettlebells with different weights to perform daily exercises. In order to achieve choosing kettlebells of different weights, for example, Taiwan Patent No. 1810242 discloses a weight-selectable kettlebell, a main body of the kettlebell is provided with a rotating shaft, by changing a rotational position of the rotating shaft, it can be combined with different weight blocks to achieve an adjustment effect.

However, the rotating shaft cannot produce a matching effect of the weight block during use. That is, the user needs to observe and adjust to determine whether the weight block is reliably combined with the rotating shaft, which is relatively inconvenient in use. In addition, the rotating shaft is fixed and cannot rotate except in an adjustment state, making it impossible to perform fine adjustments or other rotations.

SUMMARY OF THE INVENTION

One object of the invention is to provide a kettlebell that can be easily adjusted.

One object of the invention is to provide a kettlebell with clear rotational positioning.

One object of the invention is to provide a kettlebell with a rotating shaft capable of rotating freely in an unloaded state.

The invention provides a kettlebell comprising:

a main weight block stacked on a top of a plurality of weight blocks, each of the weight blocks is provided with an axle hole; a teeth meshing plate is provided on a top surface of the main weight block, the teeth meshing plate is annularly provided with a plurality of connecting grooves thereon;

a rotating shaft pivotally disposed on a main body and having a fixed shaft and a sliding shaft; the fixed shaft is radially provided with a plurality of pins capable of optionally connecting with all of the weight blocks, a through groove is formed in a center of the fixed shaft, a slot is axially provided on the fixed shaft at an upper position; the sliding shaft is inserted into the through groove, a pushed block is provided at a bottom of the sliding shaft and capable of being pushed by a pushing member to cause axial position changes; the sliding shaft is radially provided with an upper engaging rod and a lower engaging rod thereon, the upper engaging rod and the lower engaging rod pass through the slot, the lower engaging rod is capable of optionally engaging with the connecting grooves of the main weight block;

a large teeth plate elastically disposed on a top end of the main body and being able to move elastically in the main body; a through hole is provided in a center of the large teeth plate for the rotating shaft to pass through; a bottom of the large teeth plate is provided with first engaging teeth on a periphery of the through hole annularly; and a connecting plate provided with a perforation in a middle for the rotating shaft to pass through, an upper end surface of the connecting plate is annularly provided with second engaging teeth movably meshing with the first engaging teeth, a lower end surface of the connecting plate is annularly provided with connecting teeth, and the connecting teeth are connected with the upper engaging rod of the rotating shaft.

Preferably, the sliding shaft is provided with a chute thereon, the upper engaging rod is disposed in the chute to enable the upper engaging rod to displace axially relative to the sliding shaft, when the upper engaging rod moves upward, the connecting plate is capable of butting against the large teeth plate upward to form fixation; when the upper engaging rod moves downward, the connecting plate is capable of rotating relative to the large teeth plate, and the second engaging teeth are capable of elastically disengaging from the first engaging teeth.

Preferably, further comprising a handle, the handle comprises a driving block and an eccentric grip, one end of the driving block is inserted with the upper engaging rod, another end thereof is pivotally provided on an eccentric block of the eccentric grip, the eccentric block is capable of eccentrically driving the driving block to displace to enable the driving block to drive the upper engaging rod to displace.

In the kettlebell provided by the invention, the upper engaging rod on the rotating shaft is capable of driving the connecting plate to elastically mesh with the large teeth plate, so that when the rotating shaft rotates, the connecting plate can be elastically positioned on the large teeth plate. Each rotation only switches one position, so that a weight adjustment position of the weight blocks is clear. In addition, the lower engaging rod is capable of engaging on the main weight block to form an embedded fixation, which can increase a fixation effect when the weight blocks are combined on the main body, and the rotating shaft is capable of rotating freely without engaging with the weight block.

BRIEF DESCRIPTION OF DRAWINGS

The objects, features, and achieved efficacies of the invention can be understood from the description and drawings of the following preferred embodiment, in which.

DETAILED DESCRIPTION OF THE INVENTION

Figure 1:
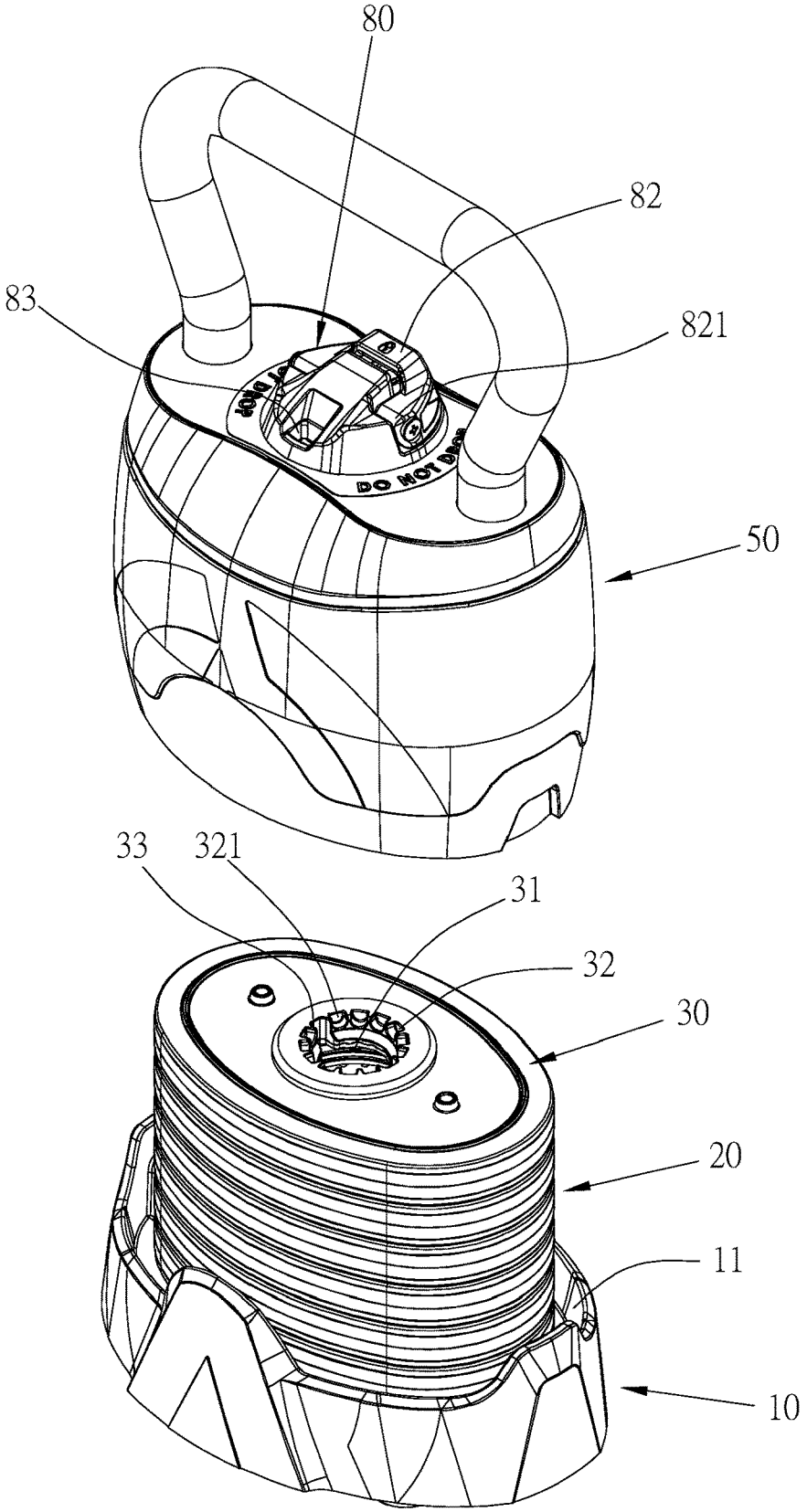
FIG. 1 is an exploded perspective view of a main body of a kettlebell according to a preferred embodiment of the invention.

Please refer to FIGS. 1 to 4 for a preferred embodiment of a kettlebell provided by the invention, mainly comprising a base 10, a plurality of weight blocks 20, a main weight block 30, a rotating shaft 40, a main body 50, a large teeth plate 60, a connecting plate 70, and a handle 80.

The base 10 has a supporting groove 11 on a top surface. The supporting groove 11 is oval in shape. A pushing member 12 is provided at a central position of the supporting groove 11. A height of the pushing member 12 is higher than a bottom surface of the supporting groove 11.

Figure 2:
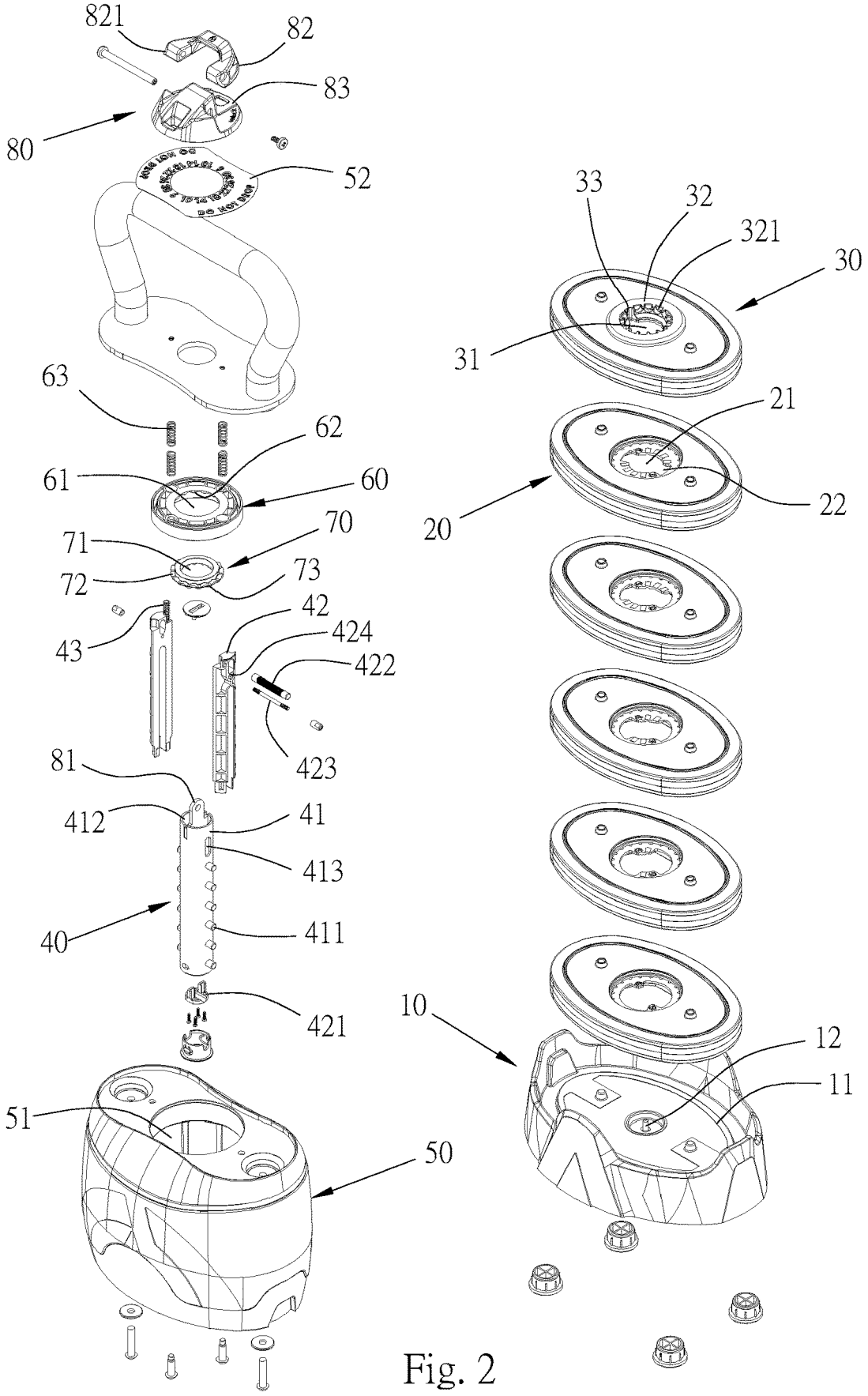
FIG. 2 is an exploded perspective view of the kettlebell according to a preferred embodiment of the invention.

Please refer to FIG. 2. The weight blocks 20, 30 are stacked up and down on the supporting groove 11 of the base 10, and are disposed in an oval shape. A center of each of the weight blocks 20, 30 has an axle hole 21, 31, each of the axle hole passes through a top and a bottom faces of each of the weight blocks. Each of the weight blocks 20, 30 is provided with a through hole 22, 33 by the axle hole 21, 31. The sizes of the through holes 22, 33 of the weight blocks 20, 30 are different, the lower the weight block 20, the larger the through hole 22.

Please refer to FIG. 2. The main weight block 30 is stacked on a top of the weight blocks 20 and is the topmost weight block. The axle hole 31 is provided in a center of the main weight block 30 to coincide with the axle holes 21 of the weight blocks 20. A teeth meshing plate 32 is disposed on a top surface of the main weight block 30, close to a circumference of the axle hole 31. The teeth meshing plate 32 is annularly provided with a plurality of connecting grooves 321 thereon. The main weight block 30 is provided with the through hole 33, the through hole 33 is disposed by connecting to the teeth meshing plate 32. A quantity of the connecting grooves 321 is twice a quantity of all of the weight blocks 20, 30.

Please refer to FIG. 2. The rotating shaft 40 is pivotally disposed on the main body 50. The rotating shaft 40 is inserted into the axle holes 21, 31 of the weight blocks 20, 30. The rotating shaft 40 has a fixed shaft 41 and a sliding shaft 42. The fixed shaft 41 is radially provided with a plurality of pins 411 capable of optionally connecting with the weight blocks 20, 30. When the pins 411 are rotated positionally to locate at the through holes 22, 33 of the weight blocks 20, 30, the rotating shaft 40 will not connect with the weight blocks 20, 30. When the pins 411 are located at positions not provided with the through holes 22, 33 of the weight blocks 20, 30, the pins 411 are capable of connecting with the weight blocks 20, 30. A through groove 412 is formed in a center of the fixed shaft 41, and a slot 413 is axially provided on the fixed shaft 41 at an upper position. The sliding shaft 42 is inserted into the through groove 412, a pushed block 421 is provided at a bottom of the sliding shaft 42 and capable of being pushed by the pushing member 12 of the base 10 to cause axial position changes of the sliding shaft 42.

The sliding shaft 42 is radially provided with an upper engaging rod 422 and a lower engaging rod 423. The upper engaging rod 422 and the lower engaging rod 423 pass through the slot 413 of the fixed shaft 41. The upper engaging rod 422 and the fixed shaft 41 actuate synchronously, and the lower engaging rod 423 is capable of optionally engaging with the connecting grooves 321 of the teeth meshing plate 32 of the main weight block 30. When the main body 50 is placed on the base 10, the pushing member 12 contacts the rotating shaft 40 and pushes the pushed block 421 upward. The lower engaging rod 423 upwardly disengages from the connecting grooves 321 of the teeth meshing plate 32 so that the rotating shaft 40 is not limited by the main weight block 30, and the rotating shaft 40 is capable of performing weight adjustment operations. When the main body 50 is separated from the base 10, the pushing member 12 cannot push the pushed block 421, the sliding shaft 42 will move downward, and the lower engaging rod 423 will also move downward. When the main weight block 30 is assembled in the main body 50, the lower engaging rod 423 is engaged in one of the connecting grooves 321, so that the lower engaging rod 423 and the main weight block 30 are engaged with each other, and the rotating shaft 40 cannot rotate. When the main weight block 30 is not assembled in the main body 50, the lower engaging rod 423 will not be limited, so that the rotating shaft 40 is capable of rotating freely. The sliding shaft 42 is provided with a chute 424 thereon, the upper engaging rod 422 is slidably disposed in the chute 424 to enable the upper engaging rod 422 to move upward and downward. An elastic member 43 is provided between a top end of the fixed shaft 41 and the sliding shaft 42 of the rotating shaft 40. The elastic member 43 is capable of generating an elastic pushing force for the sliding shaft 42. When the sliding shaft 42 is pushed upward by the pushing member 12, the elastic member 43 will also be compressed, causing the elastic member 43 to generate an elastic pushing force. After the pushing member 12 is separated from the sliding shaft 42, the elastic member 43 will generate an elastic force to push the sliding shaft 42 downward.

Figure 3:
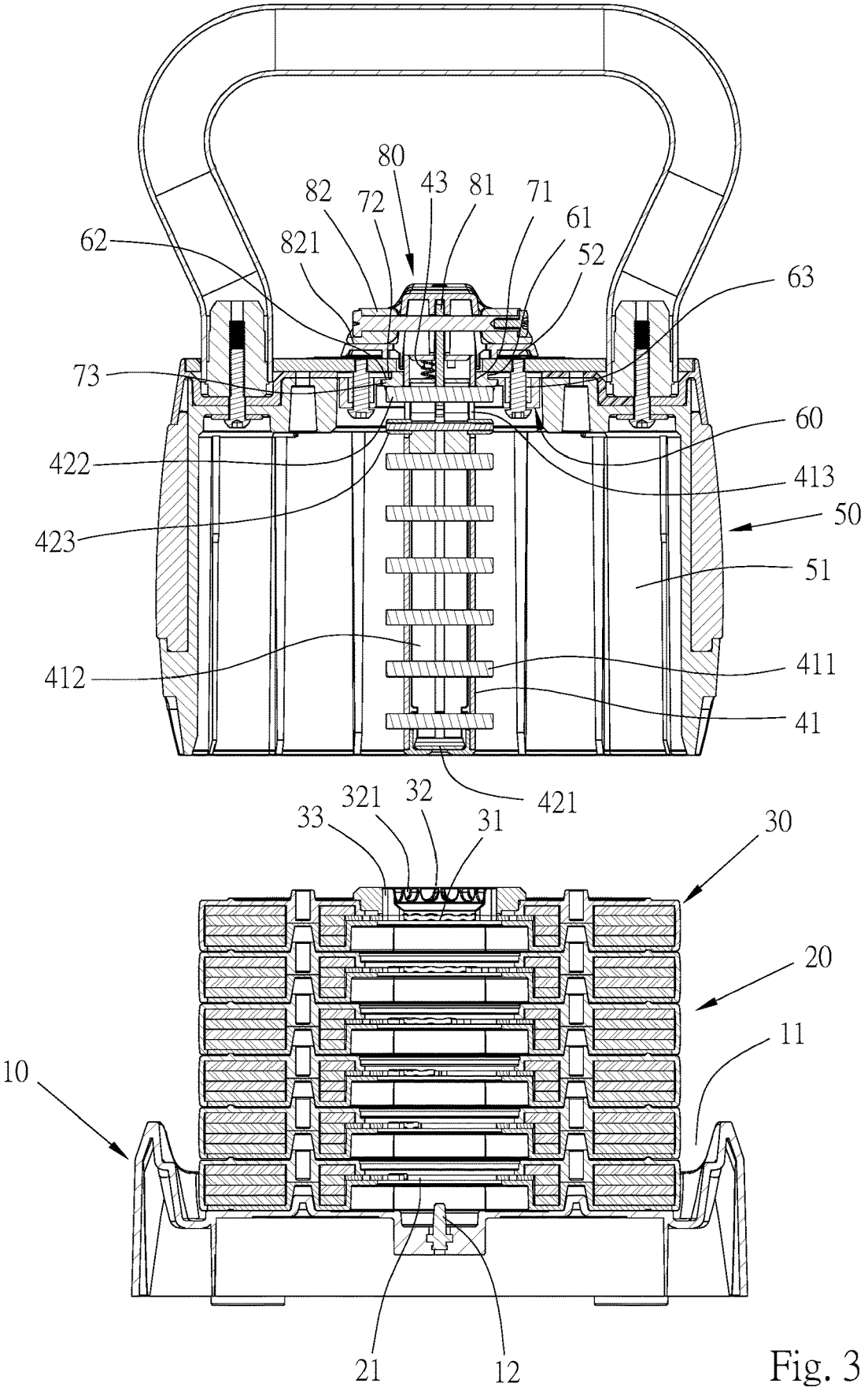
FIG. 3 is a cross-sectional view of the main body separated from a base of the kettlebell according to a preferred embodiment of the invention with the main body not combined with a main weight block or a weight block.

Please refer to FIG. 3. The main body 50 can be detachably placed on the base 10, and an accommodating chamber 51 is provided at a bottom of the main body 50 for accommodating the weight blocks 20, 30. A top surface of the main body 50 is provided with a weight display part 52. The weight display part 52 is annularly provided with a plurality of weight values, which correspond to different weight value changes of the weight blocks 20 and the main weight block 30.

Please refer to FIG. 2. The large teeth plate 60 is axially slidably disposed in a top end of the accommodating chamber 51 of the main body 50. A through hole 61 is provided in a center of the large teeth plate 60 for the rotating shaft 40 to pass through. A bottom of the large teeth plate 60 is provided with first engaging teeth 62 on a periphery of the through hole 61 annularly. A top surface of the large teeth plate 60 is provided with four elastic elements 63 so that the large teeth plate 60 can be elastically disposed on the top end of the accommodating chamber 51 of the main body 50 and is movable elastically relative to the main body 50.

Please refer to FIG. 2. The connecting plate 70 has a perforation 71 in a middle for the rotating shaft 40 to pass through. An upper end surface of the connecting plate 70 is annularly provided with second engaging teeth 72 movably meshing with the first engaging teeth 62. A lower end surface of the connecting plate 70 is annularly provided with connecting teeth 73, and the connecting teeth 73 are connected with the upper engaging rod 422 of the rotating shaft 40. A quantity of the second engaging teeth 72 is the same as a quantity of the connecting teeth 73, and are symmetrically disposed.

The handle 80 comprises a driving block 81 and an eccentric grip 82. One end of the driving block 81 is inserted with the upper engaging rod 422 of the rotating shaft 40, and another end thereof is pivotally disposed on an eccentric block 821 of the eccentric grip 82. When the eccentric block 821 rotates, an eccentricity is generated to drive the driving block 81 to displace. When the eccentric grip 82 is pulled upward, the driving block 81 moves with the upper engaging rod 422, and the driving block 81 moves downward relatively. When the eccentric grip 82 is pressed downward, the driving block 81 rises relatively. When the driving block 81 moves upward, that is, the eccentric grip 82 is pressed downward, the upper engaging rod 422 is driven to move upward. When the driving block 81 displaces downward, that is, the eccentric grip 82 is pulled upward, the upper engaging rod 422 moves downward. When the main body 50 is located on the base 10, the sliding shaft 42 is pushed upward. When the eccentric grip 82 is maintained in a downwardly pressed state, a position of the upper engaging rod 422 is driven upward, and the upper engaging rod 422 causes the connecting plate 70 to butt against the large teeth plate 60 upwardly, the large teeth plate 60 is fixed close to the top end of the main body 50, and the connecting plate 70 cannot be separated from the large teeth plate 60. When the main body 50 is located on the base 10, the sliding shaft 42 is pushed upward. At this time, the eccentric grip 82 is pulled upward, the upper engaging rod 422 is driven downward by the driving block 81, and the connecting plate 70 moves downward along with the upper engaging rod 422. An elastic force of the elastic elements 63 pushes the large teeth plate 60 away from the main body 50. A gap is provided between the large teeth plate 60 and the main body 50 so that the connecting plate 70 is capable of rotating relative to the large teeth plate 60. When the connecting plate 70 rotates, the second engaging teeth 72 push the first engaging teeth 62 upward, and one of the second engaging teeth 72 elastically disengages from one of the first engaging teeth 62 and rotates in a direction toward one of the other first engaging teeth 62, and an elastic force of the elastic elements 63 of the large teeth plate 60 pushes the first engaging teeth 62 to mesh with the second engaging teeth 72 to form a switching action. A single switching is a weight selection switch of the weight blocks 20, 30. The handle 80 is provided with a display window 83 relative to the weight display part 52 of the main body 50 to enable a user to observe a currently adjusted weight value from a position of the display window 83.

Please refer to FIGS. 3 to 6. When in use, when the main body 50 is not disposed on the base 10, and the weight blocks 20, 30 are not assembled in the main body 50, all of the weight blocks 20, 30 are disposed on the base 10. The main body 50 and the rotating shaft 40 are not combined with all of the weight block 20, 30. The main body 50 only has its weight, that is, a lightest weight. At this time, the lower engaging rod 423 on the rotating shaft 40 is not limited positionally, the pushed block 421 is not pushed, and the upper engaging rod 422 is not meshed with the connecting plate 70. Therefore, the rotating shaft 40 and the handle 80 are capable of rotating freely, when the upper engaging rod 422 rotates, the connecting plate 70 is not driven to rotate. An elastic force of the elastic elements 63 of the large teeth plate 60 pushes the large teeth plate 60 to combine with the connecting plate 70, so that the large teeth plate 60 and the connecting plate 70 are maintained at fixed positions. The rotating shaft 40 and the handle 80 are in a freely rotatable state, enabling the user to adjust a position of the rotating shaft 40. At this time, regardless of whether the driving block 81 of the handle 80 ascends or descends, because the pushed block 421 of the sliding shaft 42 has not been pushed upward, the upper engaging rod 422 is not meshed with the connecting plate 70. That is, the upper engaging rod 422 cannot drive the connecting plate 70 to rotate. In this way, a position of the rotating shaft 40 can be freely adjusted in the main body 50, so that before the rotating shaft 40 engages with any of the weight blocks 20, 30, positions of the pins 411 can be adjusted to initial positions. In addition, if different weight blocks are combined, the axle holes have different positions, the rotating shaft 40 can be adjusted accordingly to suit dispositions at different positions.

Please refer to FIGS. 4, 4A, 4B and 5, 5A, 5B. When adjusting a weight of the kettlebell, the main body 50 is disposed on the base 10. At this time, the rotating shaft 40 passes through the axle holes 21, 31 of the weight blocks 20, 30, and the pins 411 on the rotating shaft 40 pass through the through hole 33 of the main weight block 30 and the through holes 22 of the weight blocks 20. After the main body 50 is fixed on the base 10, the pushed block 421 of the sliding shaft 42 of the rotating shaft 40 is pushed by the pushing member 12, causing the lower engaging rod 423 to move upward to maintain a distance from the teeth meshing plate 32 of the main weight block 30. At the same time, the elastic member 43 is pressed to generate an elastic pushing force.

Figure 5:
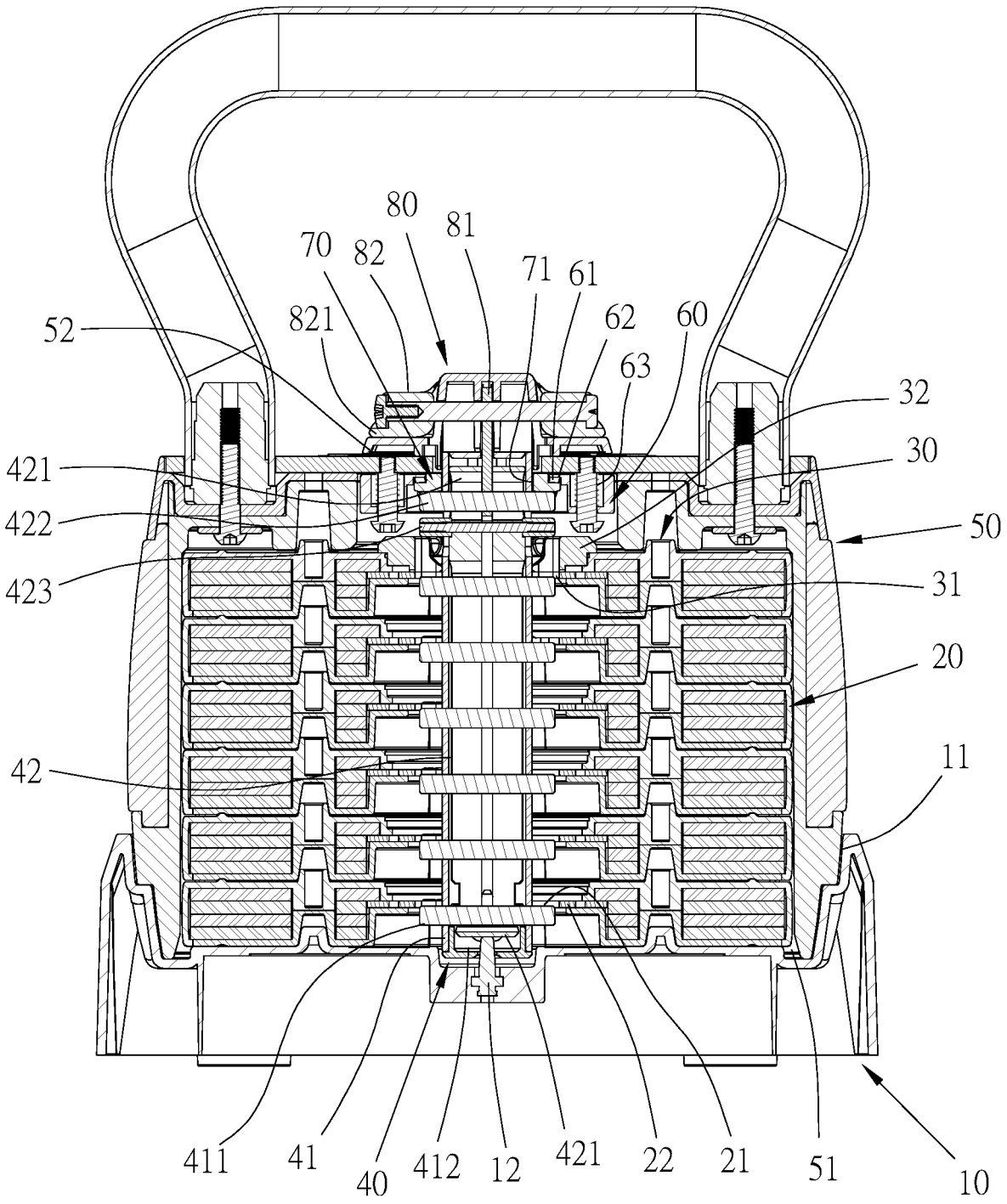
FIG. 5 is a cross-sectional view of combination of the main body and the base of the kettlebell according to a preferred embodiment of the invention with the rotating shaft in a state without combination of the weight block and with the eccentric grip being pressed down.
Figure 5A:
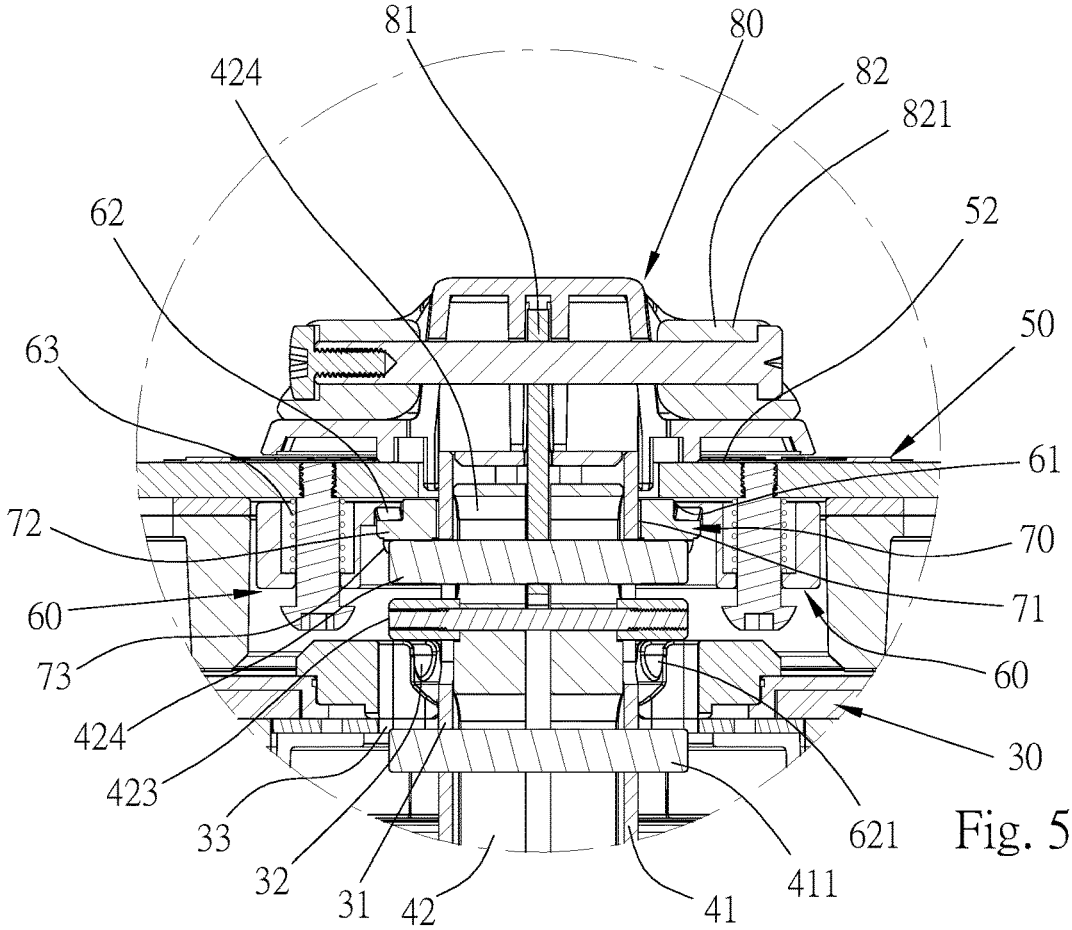
FIG. 5A is a partially enlarged cross-sectional view of FIG. 5.
Figure 5B:
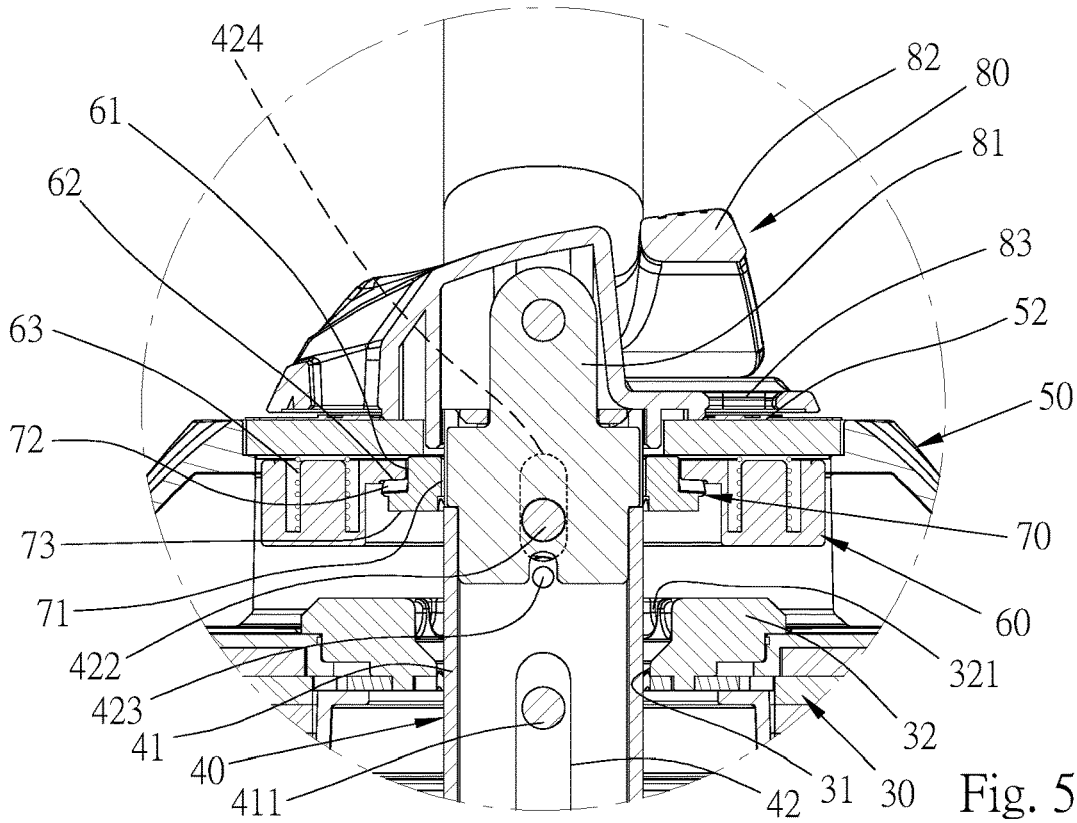
FIG. 5B is a partially enlarged cross-sectional view perpendicular to FIG. 5.

Then, please refer to FIGS. 5, 5A and 5B. When the main body 50 is disposed on the base 10, the pushing member 12 pushes the sliding shaft 42 to move upward. When the eccentric grip 82 is pressed down, the upper engaging rod 422 is lifted up by the driving block 81, enabling the upper engaging rod 422 to drive the connecting teeth 73 to move upward, causing the connecting plate 70 to move upward, and the connecting plate 70 is moved toward the large teeth plate 60. As a result, the large teeth plate 60 is pressed and moves toward the top end of the accommodating chamber 51 of the main body 50, the second engaging teeth 72 and the first engaging teeth 62 are fixed with one another, and the connecting plate 70 cannot be adjusted.

Figure 4:
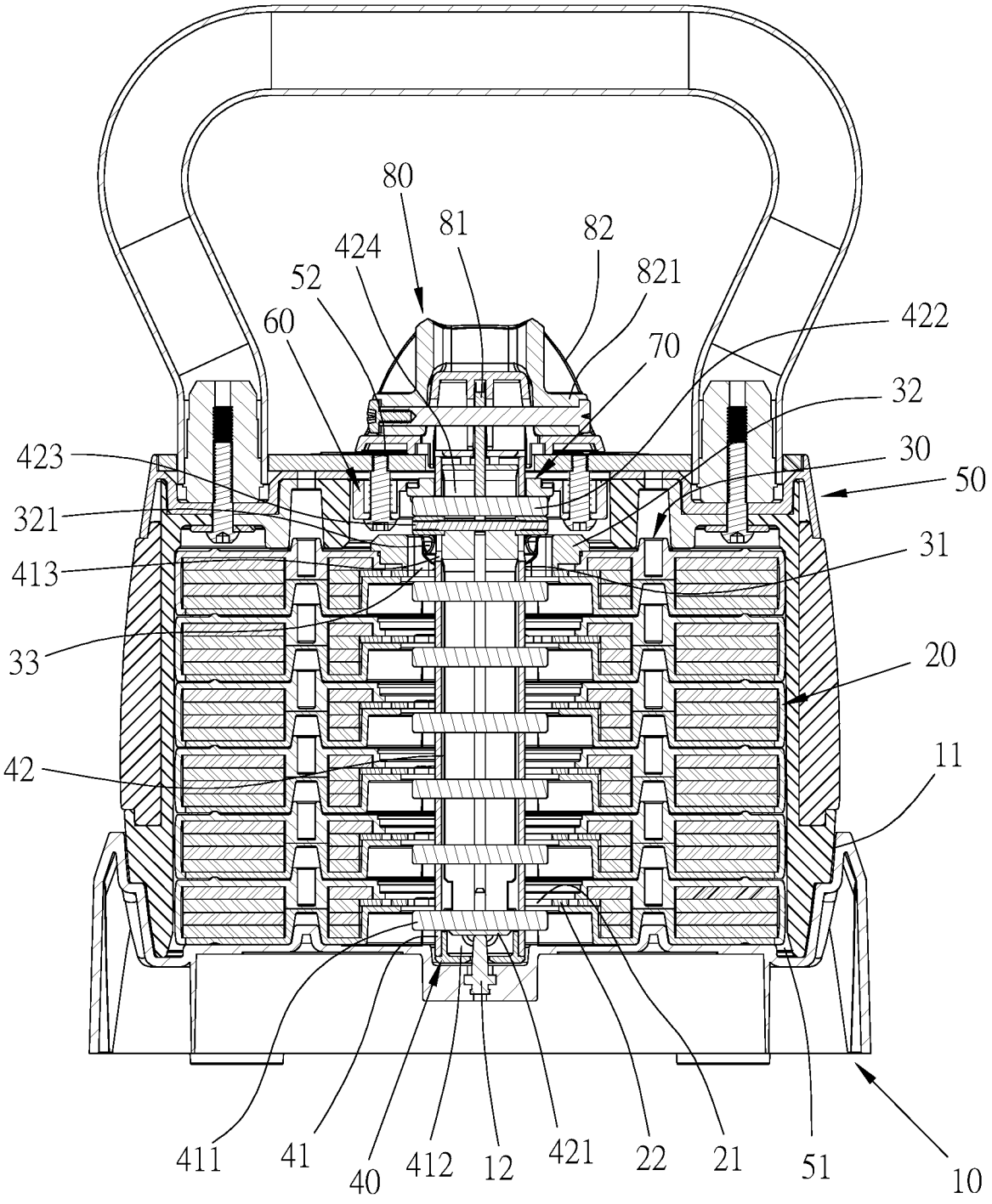
FIG. 4 is a cross-sectional view of combination of the main body and the base of the kettlebell according to a preferred embodiment of the invention with a rotating shaft in a state without combination of the weight block and with an eccentric grip being lifted up.
Figure 4A:
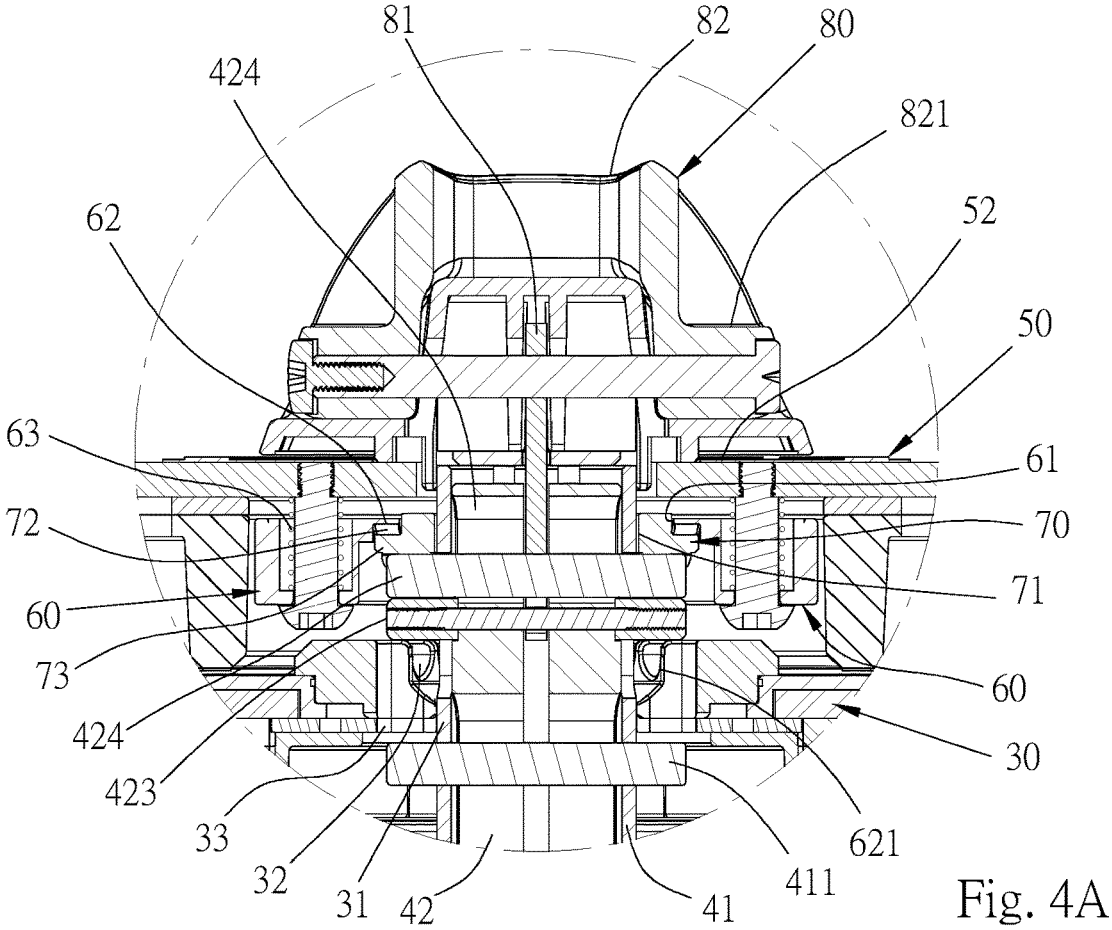
FIG. 4A is a partially enlarged cross-sectional view of FIG. 4.
Figure 4B:
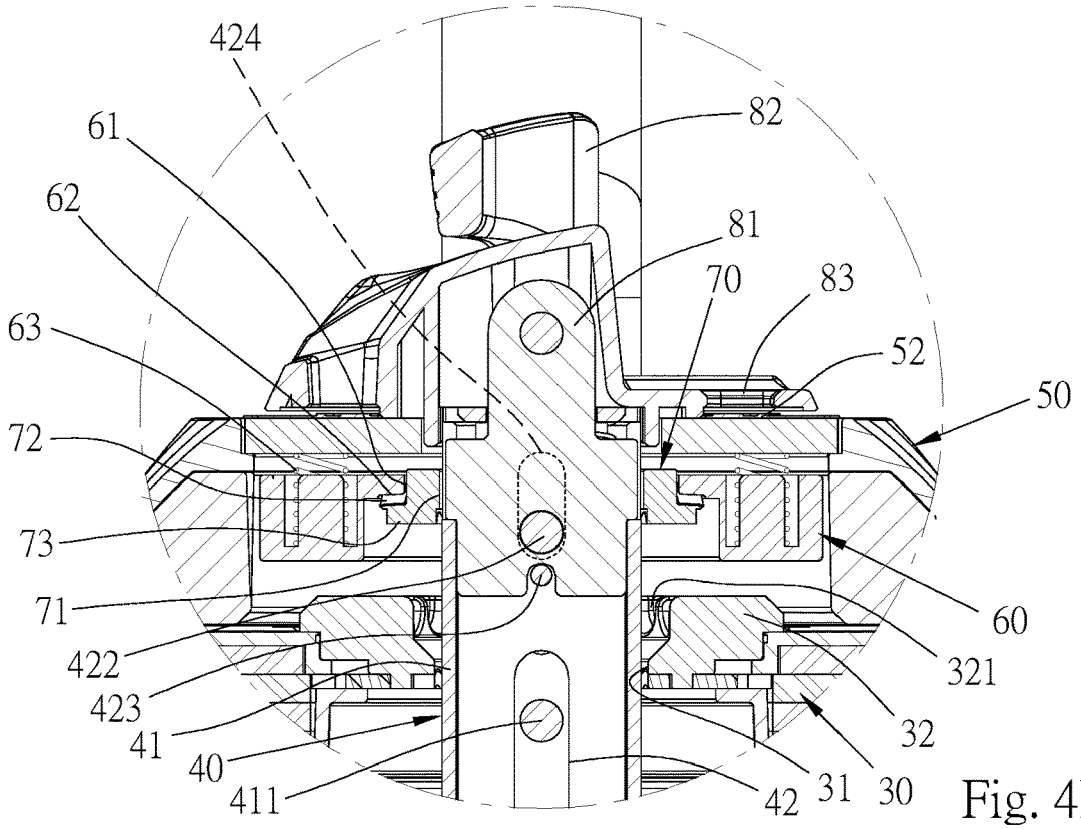
FIG. 4B is a partially enlarged cross-sectional view perpendicular to FIG. 4.

Please refer to FIGS. 4, 4A and 4B. When the main body 50 is disposed on the base 10 and a position of the rotating shaft 40 is to be adjusted, that is, weight adjustment. The eccentric grip 82 is pulled upward to lower a position of the eccentric block 821, the driving block 81 descends accordingly, thereby causing the upper engaging rod 422 to descend. At this time, an elastic force of the elastic elements 63 of the large teeth plate 60 pushes the large teeth plate 60 and the connecting plate 70 downward, and the connecting teeth 73 of the connecting plate 70 are engaged with the upper engaging rod 422. Then, the handle 80 is rotated, so that the upper engaging rod 422 drives the connecting teeth 73 to rotate, and the second engaging teeth 72 also rotate along with the connecting teeth 73. The first engaging teeth 62 are actuated by the second engaging teeth 72 to produce a teeth displacement action that moves upward, causing the large teeth plate 60 to move upward. At the same time, the elastic elements 63 generate an elastic restoring force, when one of the second engaging teeth 72 rotates to mesh with one of the other first engaging teeth 62, an elastic force of the elastic elements 63 pushes the large teeth plate 60 to restore, so that the first engaging teeth 62 mesh with the second engaging teeth 72 again. At this time, the pins 411 of the rotating shaft 40 rotate at a predetermined angle, which is an angle at which a weight of the weight blocks 20, 30 is adjusted. For example, the invention discloses that the five weight blocks 20 and the weight block 30 are provided, so the connecting teeth 73 will have seven angle switches, that is, seven different configurations of weight blocks 20, 30 can be provided (no weight block, the main weight block 30, the main weight block 30 and one to five of the weight blocks 20). The user will feel a switching action between the second engaging teeth 72 and the first engaging teeth 62 in every switching, and can also determine a reversing angle and completion of adjustment of the weight blocks 20, 30, and weight values of the weight blocks 20, 30 displayed by the weight display part 52 can be observed from the display window 83 of the handle 80. After adjustment is completed, the eccentric grip 82 is pressed down to move the driving block 81 upward, so that the upper engaging rod 422 pushes the connecting teeth 73 upward, the connecting plate 70 drives the large teeth plate 60 to push upward, and the second engaging teeth 72 cannot move on the first engaging teeth 62.

Figure 6:
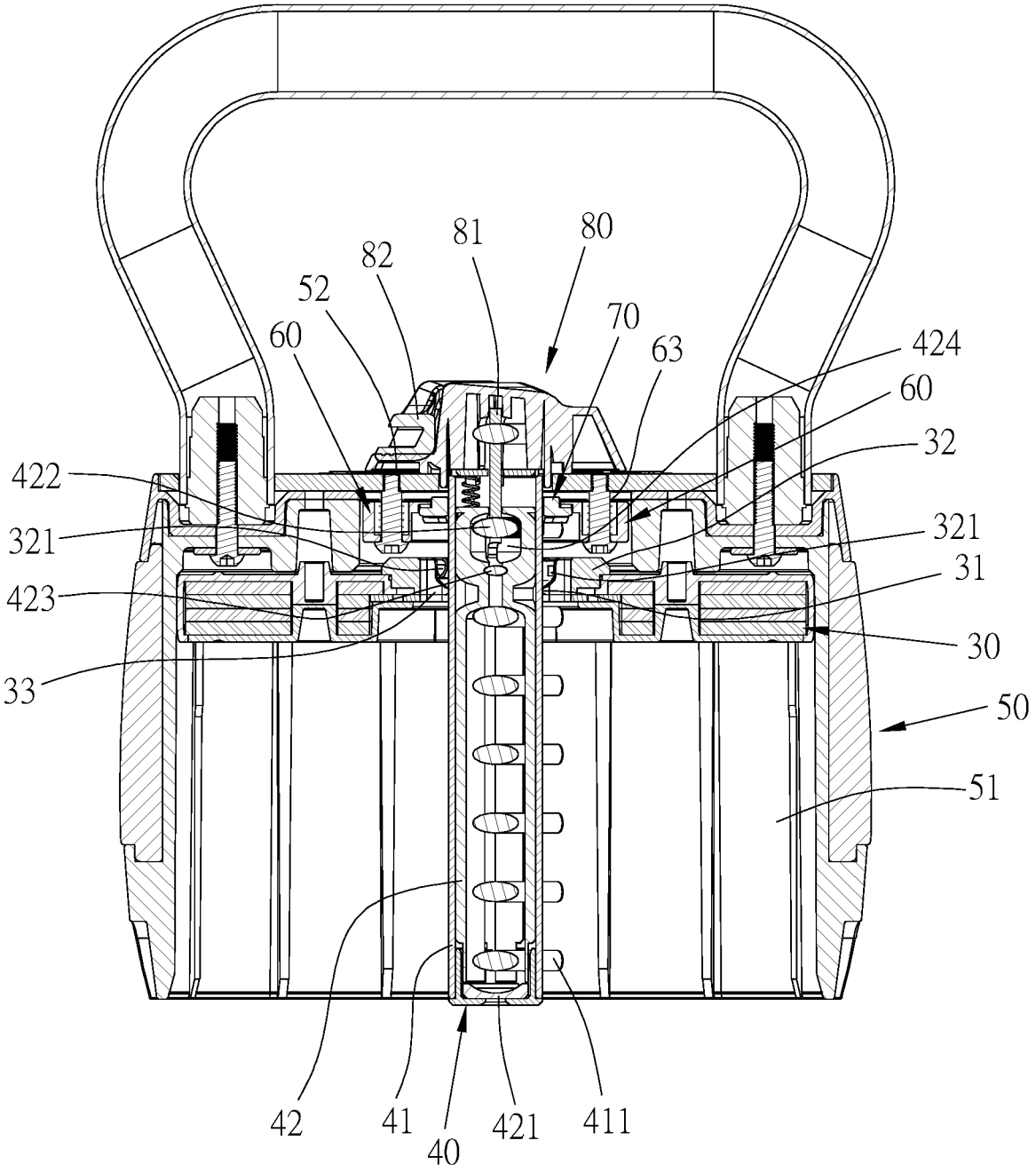
FIG. 6 is a cross-sectional view of the main body of the kettlebell being lifted up and combined with the main weight block according to a preferred embodiment of the invention.
Figure 6A:
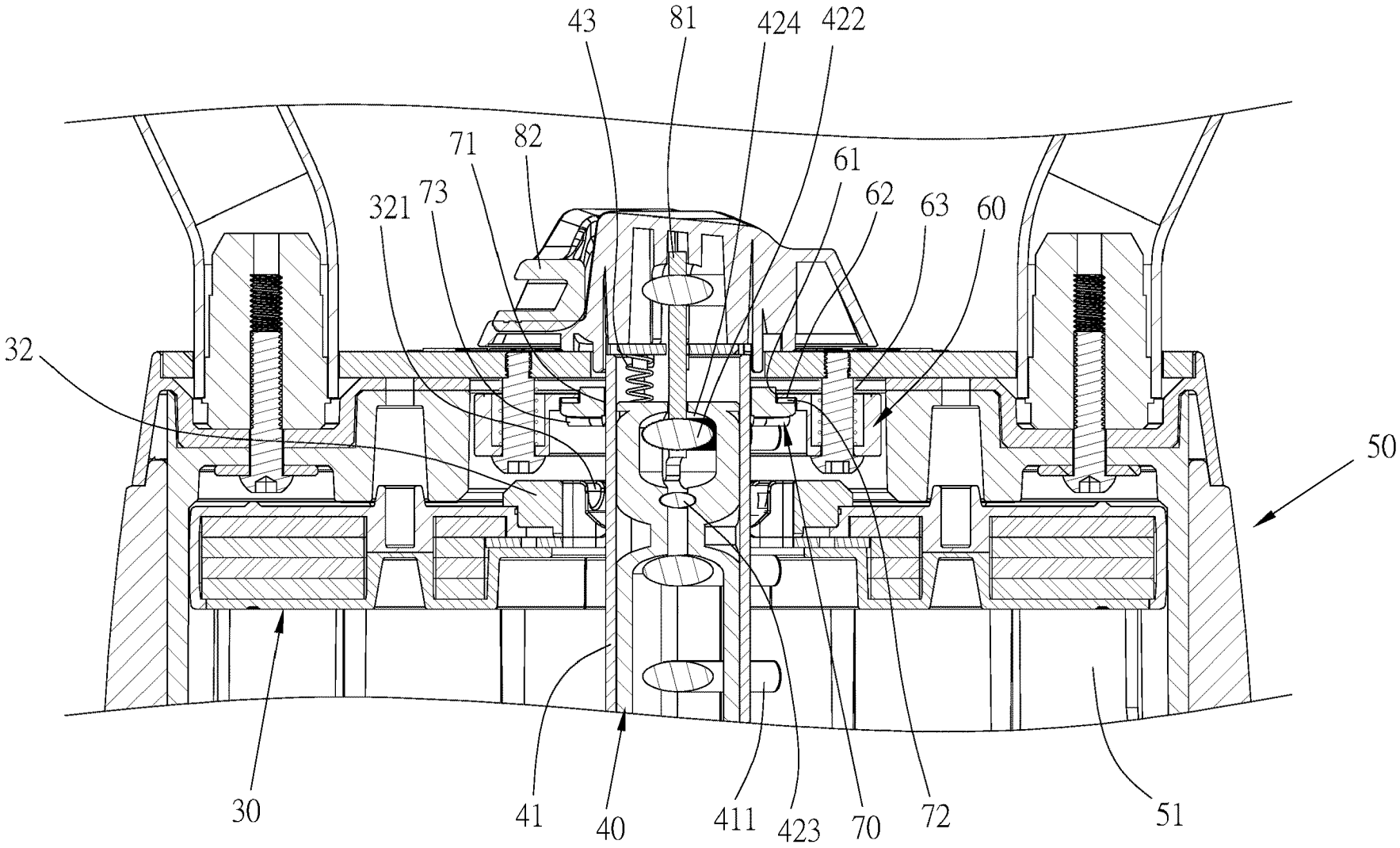
FIG. 6A is a partially enlarged cross-sectional view of FIG. 6.

Please refer to FIG. 6 and FIG. 6A. When in use, the main body 50 is lifted, and the pins 411 of the rotating shaft 40 assemble the selected through holes 22, 33 of the weight blocks 20, 30 on the rotating shaft 40. In this embodiment, the pins 411 of the rotating shaft 40 are combined with the main weight block 30, and the weight blocks 20 are not combined. When the main body 50 is lifted, the pushed block 421 is not pushed by the pushing member 12, an elastic pushing force of the elastic member 43 pushes the sliding shaft 42 and the pushed block 421 downward, causing the lower engaging rod 423 to be engaged downwardly in the connecting grooves 321 of the teeth meshing plate 32 of the main weight block 30 to form fixation. Therefore, when the rotating shaft 40 is combined with at least the main weight block 30, the lower engaging rod 423 limits rotation of the rotating shaft 40, thereby preventing accidental touching by the user when the main body 50 is assembled with the weight blocks.

In the kettlebell provided by the invention, fixation is formed through the lower engaging rod and the teeth meshing plate of the main weight block. Compared with the conventional kettlebell with the main shaft being fixed to the main body, the rotating shaft of the invention is capable of rotating freely without being combined with the main weight block and when the main body is not disposed on the base, enabling the user to adjust a position of the rotating shaft. In addition, through the upper engaging rod driving the connecting plate to form a meshing structure between the connecting plate and the large teeth plate, rotation position of the rotating shaft can be made clear and reliability of adjustment and positioning of the weight blocks can be ensured.

Although the invention has been disclosed as above with the embodiment, it is not intended to limit the invention. A person having ordinary skill in the art to which the invention pertains can make various changes and modifications without departing from the spirit and scope of the invention. Therefore, scope of protection of the invention shall be subject to what is defined in the pending claims.

What is claimed is:

1. A kettlebell comprising:

a base having a pushing member;

a plurality of weight blocks stacked on the base, each of the plurality of weight blocks having an axle hole;

a main weight block stacked on a top of the plurality of weight blocks, the main weight block being provided with an axle hole; a teeth meshing plate being provided on a top surface of the main weight block, the teeth meshing plate being annularly provided with a plurality of connecting grooves thereon;

a main body detachably placed on the base, an accommodating chamber being provided at a bottom of the main body for accommodating all of the plurality of weight blocks;

a rotating shaft pivotally disposed on the main body and having a fixed shaft and a sliding shaft; the fixed shaft being radially provided with a plurality of pins capable of optionally connecting with all of the plurality of weight blocks, a through groove being formed in a center of the fixed shaft, a slot being axially provided on the fixed shaft at an upper position; the sliding shaft being inserted into the through groove, a pushed block being provided at a bottom of the sliding shaft and capable of being pushed by the pushing member to cause axial position changes; the sliding shaft being radially provided with an upper engaging rod and a lower engaging rod thereon, the upper engaging rod and the lower engaging rod passing through the slot, the lower engaging rod being capable of optionally engaging with the plurality of connecting grooves of the main weight block;

a large teeth plate elastically disposed on a top end of the accommodating chamber of the main body and being movable elastically in the main body; a through hole being provided in a center of the large teeth plate for the rotating shaft to pass through; a bottom of the large teeth plate being provided with first engaging teeth on a periphery of the through hole annularly; and a connecting plate provided with a perforation in a middle for the rotating shaft to pass through, an upper end surface of the connecting plate being annularly provided with second engaging teeth movably meshing with the first engaging teeth, a lower end surface of the connecting plate being annularly provided with connecting teeth, and the connecting teeth being connected with the upper engaging rod of the rotating shaft.

2. The kettlebell as claimed in claim 1, wherein the sliding shaft is provided with a chute thereon, the upper engaging rod is disposed in the chute to enable the upper engaging rod to displace axially relative to the sliding shaft, when the upper engaging rod moves upward, the connecting plate is capable of butting against the large teeth plate upward to form fixation; when the upper engaging rod moves downward, the connecting plate is capable of rotating relative to the large teeth plate, and the second engaging teeth are capable of elastically disengaging from the first engaging teeth.

3. The kettlebell as claimed in claim 2, further comprising a handle having a driving block and an eccentric grip, one end of the driving block being inserted with the upper engaging rod, another end thereof being pivotally provided on an eccentric block of the eccentric grip, the eccentric block being capable of eccentrically driving the driving block to displace to enable the driving block to drive the upper engaging rod to displace.

4. The kettlebell as claimed in claim 3, wherein the main body is provided with a weight display part thereon, the handle is provided with a display window thereon, the display window is capable of displaying the corresponding weight display part.

5. The kettlebell as claimed in claim 1, wherein the main weight block is provided with a through hole by the axle hole of the main weight block, the through hole is adjacent to the teeth meshing plate.

6. The kettlebell as claimed in claim 5, wherein a quantity of the plurality of connecting grooves of the teeth meshing plate on the main weight block is twice a quantity of all of the plurality of weight blocks.

7. The kettlebell as claimed in claim 1, wherein a plurality of elastic elements are provided between the large teeth plate and the main body.

8. The kettlebell as claimed in claim 1, wherein each of the plurality of weight blocks is provided with a through hole by the axle hole for the pins to pass through, and the sizes of the through holes of the different weight blocks are different.

9. The kettlebell as claimed in claim 1, wherein a quantity of the plurality of connecting grooves of the teeth meshing plate on the main weight block is twice a quantity of all of the plurality of weight blocks.

10. The kettlebell as claimed in claim 1, wherein the base has a supporting groove on a top surface, the pushing member is provided in the supporting groove, a height of the pushing member is higher than a bottom surface of the supporting groove, and the plurality of weight blocks are provided in the supporting groove.

11. The kettlebell as claimed in claim 1, wherein a quantity of the second engaging teeth of the connecting plate is the same as a quantity of the connecting teeth, and are symmetrically disposed.

12. The kettlebell as claimed in claim 1, wherein an elastic member is provided between a top end of the fixed shaft and the sliding shaft of the rotating shaft, the elastic member is capable of generating an elastic pushing force for the sliding shaft.

* * * * *